US005264815A

United States Patent [19]

Umeya et al.

[11] Patent Number: 5,264,815

[45] Date of Patent: Nov. 23, 1993

[54] FASTENER FOR ELECTRONIC COMPONENT

[75] Inventors: Tatuo Umeya; Hidetoshi Suzuki; Toru Mizuno; Tokio Tadano; Takashi Shioura, all of Tokyo, Japan

[73] Assignees: TDK Corporation, Tokyo; Fujitsu Limited, Kawasaki, both of Japan

[21] Appl. No.: 527,076

[22] Filed: May 21, 1990

[30] Foreign Application Priority Data

May 23, 1989 [JP] Japan ..... 1-59271

[51] Int. Cl.[5] ..... H01F 27/26; H01F 27/30

[52] U.S. Cl. ..... 336/96; 24/329; 24/563; 248/316.7; 336/98; 336/197; 336/198; 336/210

[58] Field of Search ..... 248/316.7, 231.8; 24/338, 329, 563; 336/210, 197, 65, 83, 96, 98, 198

[56] References Cited

U.S. PATENT DOCUMENTS

| | | | |
|---|---|---|---|
| 648,456 | 5/1900 | Fay | 24/563 |
| 1,319,997 | 10/1919 | Galloway et al. | 24/563 |
| 2,184,249 | 12/1939 | Churchill | 24/563 |
| 2,467,604 | 4/1949 | Tinnerman et al. | 24/563 |
| 2,523,785 | 9/1950 | Sereno | 248/316.7 |
| 3,003,736 | 10/1961 | Hofgesang | 248/316.7 |
| 3,069,539 | 12/1962 | Kidd | 248/316.7 |
| 3,533,589 | 10/1970 | Schellmann | 336/83 |
| 3,765,065 | 10/1973 | Hay | 24/563 |
| 3,809,799 | 5/1974 | Taylor | 248/316.7 |
| 4,779,068 | 10/1988 | Sakamoto et al. | 336/210 |
| 4,939,494 | 7/1990 | Masuda et al. | 336/210 |
| 4,990,880 | 2/1991 | Albert | 248/316.7 |

*Primary Examiner*—Thomas J. Kozma
*Attorney, Agent, or Firm*—Helfgott & Karas

[57] ABSTRACT

A combination of a fastener with an electronic component, wherein the electronic component includes a bobbin having an axial portion, windings around the axial portion of the bobbin, external terminals projecting from the bobbin, around each of which external terminals a termination of one of the windings is coiled, a mold covering the bobbin in a manner to allow portions of the external terminals to be projected outwardly from the mold, the mold being formed of electrically insulating resin material, and a pair of cores assembled to the mold so as to be opposed to each other. The fastener fitted on the electronic component includes a first engaging member engaged in assembly with the cores to clamp the cores, a second engaging member engaged in assembly with a portion of the mold, and an interconnecting member interconnecting the first and second engaging members.

30 Claims, 2 Drawing Sheets

FASTENER FOR ELECTRONIC COMPONENT

BACKGROUND OF THE INVENTION

1. Field of the Invention

This invention relates to a fastener for an electronic component, and more particularly to a fastener when an inductance element such as a surface-mounted-type pulse transformer or the like, which is adapted to be used in a hybrid integrated circuit for, e.g., a digital transmission, is assembled.

2. Description of the Prior Art

The assembling of a surface-mounted-type inductance element of this type is generally performed by preparing a bobbin having a terminal block formed integrally therewith, coiling primary and secondary wires around an axial portion of the bobbin, winding a termination of each of the primary and secondary coils around one of external terminals attached to the terminal block of the bobbin and assembling cores to the bobbin. Unfortunately, in the inductance element assembled in the manner described above, the coils around the bobbin are exposed to the external air, so that when the inductance element is soldered onto a printed circuit board by, for example, reflow-soldering the external terminals to conductive patterns of the printed circuit board, the inductance element will be badly affected by heat required and solder used in the soldering operation. After the inductance element is soldered onto the printed circuit board, it is generally cleaned by a solvent. When the inductance element is cleaned by a solvent, it will also be badly affected by the solvent, since the coils around the bobbin are exposed to the external air as described above. Furthermore, the inductance element in which the coils around the bobbin are exposed to the external air as described above is unable to resist moisture. That is, the inductance element constructed in the manner described above is inferior in heat resistance, solder resistance and moisture resistance. Thus, it is considerably susceptible to an external environment.

In order to overcome the disadvantages of the inductance element, the whole inductance element including the cores may be covered by electrically insulating resin material having heat resistance, with the external terminals being projected outwardly. However, when the whole inductance element including the cores is covered by the electrically insulating resin material, stress associated with hardening of the resin material and stress associated with expansion and contraction of the resin material occurring due to a temperature change may cause the cores to be separated from each other and/or destroy the cores, resulting in the magnetic characteristics of the inductance element significantly deteriorating.

In an effort to overcome the problem of the deterioration of the magnetic characteristics brought about during the assembling of the inductance element, a design, as disclosed in a patent application which was filed in U.S.A. on Apr. 24, 1989 and is now pending in the United States Patent and Trademark Office as application Ser. No. 342,216, was tried. This design comprises a bobbin; windings around the bobbin; external terminals projecting from the bobbin, around each of which external terminals a termination of one of the windings is coiled; a mold covering the bobbin in a manner to allow portions of the external terminals to be projected outwardly from the mold, the mold being formed of resin material having heat resistance and including a base portion covering a substantially lower portion of the bobbin, a step portion covering a substantially middle portion of the bobbin and including a through-hole section covering a surface of a bore of the bobbin, and a top portion covering a substantially upper portion of the bobbin; and a pair of cores assembled to the resin mold in a manner to be inserted at their portions in the through-hole section of the mold and disposed between the top portion and base portion of the resin mold. In U.S. patent application as stated above, it is suggested that after the cores are assembled to the resin mold, the cores are fastened to the resin mold by means of a self-adhering tape or a clip. As clearly seen from FIG. 6 of the drawings accompanying U.S. patent application as stated above, when a self-adhering tape is employed, the self-adhering tape is applied to the cores in a manner to substantially surround the cores and, when a clip is to be employed, a clip of a substantially U-shape is prepared and fitted on the cores in a manner to substantially surround the cores. Each of these conventional fasteners in use may clamp the cores in a manner to cause the cores to come into contact with each other, but can not effectively position the cores with respect to the resin mold because each of these conventional fasteners is designed so as to be applied to the cores only. Therefore, in the case where a size of a mold, a size of a through-hole section of the mold and/or a size of a space between top and base portions of the resin mold vary from inductance element to inductance element, when a pair of cores are assembled to a resin mold of a certain inductance element, any space may be produced between the cores, assembled to the resin mold, and the mold. In this case, when any vibration, shock and/or impact are accidentally applied to the inductance element, even though the cores are clamped by the conventional clip or self-adhering tape, the cores may be jolted by the vibration, shock and impact. Therefore, the inductance elements to which these conventional fasteners are applied are inferior in vibration resistance, shock resistance and impact resistance.

The jolting of cores which may occur, when any vibration, shock and/or impact are accidentally applied to an inductance element having the cores, may be prevented by fixing the cores to a resin mold of the inductance element by means of adhesives. However, in the case where fixing of the cores to the resin mold is performed by bonding the cores to the resin mold by means of adhesives and thereafter the inductance element is cleaned by a solvent, such solvent may bring about dissolving or peeling of the adhesives, resulting in the cores tending to slip off the resin mold. Further, in the case where adhesives are applied to the cores and resin mold, the cores may be badly affected by bonding stress, which will be produced upon applying of the adhesives. Furthermore, stress associated with expansion and contraction of the applied adhesives which will occur due to a temperature change may degrade characteristics of the cores. Therefore, it is undesirable that fixing of cores to a resin mold is carried out using adhesives. Alternatively, the whole inductance element covered by a resin mold, in which cores are clamped by means of the conventional self-adhering tape or clip, may be further covered with a resin mold. However, the inductance element assembled in the manner described above becomes large-sized, so that the inductance element is not suitable for high density mounting of electronic components.

SUMMARY OF THE INVENTION

The present invention has been made with a view to overcoming the foregoing problems of the prior art fasteners.

It is therefore an object of this invention to provide a fastener for an electronic component, which can not only effectively clamp cores but also effectively fasten the cores to a resin mold.

It is another object of this invention to provide a fastener for an electronic component as stated above, which can positively position cores with respect to a resin mold, even though any spacing is produced between the cores and the resin mold when the cores are assembled to the resin mold for assembly of the electronic component, so that the fastener is useful in providing the electronic component with vibration resistance, shock resistance and impact resistance.

It is yet another object of this invention to provide a fastener for an electronic component as stated above, which can be easily applied to the electronic component without degrading characteristics of cores.

It is a further object of this invention to provide a fastener for an electronic component as stated above, which can be manufactured easily and at low cost.

It is still further object of this invention to provide a fastener for an electronic component as stated above, which is useful in enhancing the effect of shielding magnetism in the electronic component.

In accordance with the present invention, a fastener for an electronic component is provided. The electronic component comprises a bobbin having an axial portion, windings around the axial portion of the bobbin, external terminals projecting from the bobbin, around each of which external terminals a termination of one of the windings is coiled, a mold covering the bobbin in a manner to allow portions of the external terminals to be projected outwardly from the mold, the mold being formed of electrically insulating resin material, and a pair of cores assembled to the mold so as to be opposed to each other. The fastener comprises a first engaging member being engaged with the cores, when the fastener is applied to the electronic component, to clamp the cores, a second engaging member being engaged with a portion of the mold when the fastener is applied to the electronic component, and an interconnecting member interconnecting the first and second engaging members.

The first and second engaging members and the interconnecting member are integrally formed of elastic material. The first and second engaging members and the interconnecting member may be integrally for-med of a thin metal plate. The metal plate is a thin stainless steel plate. The first and second engaging members and the interconnecting member may be integrally formed of a relatively hard synthetic resin material which has heat resistance and solvent resistance as well as elasticity.

The mold of the electronic component may comprises a base portion covering a substantially lower portion of the bobbin, a step portion covering a substantially middle portion of the bobbin and including a through-hole section covering a surface of a bore of the bobbin, and a top portion covering a substantially upper portion of the bobbin. Each of the cores may take the form of a substantially E-shaped body and is seated with respect to the step portion of the resin mold so as to be inserted, at its middle projecting section, in the through-hole section of the resin mold. One of the cores may take the form of a substantially E-shaped body and is seated with respect to the step portion of the resin mold so as to be inserted, at its middle projecting section, in the through-hole section of the resin mold, while the other of the cores may take the form of a substantially I-shaped body and is seated with respect to the step portion of the mold so as to come into contact with the E-shaped core.

The top portion of the mold may be provided with means serving to specify a polarity and a direction of the electronic component. The means of the mold may take the form of a recess.

In a preferred embodiment of the present invention, each of the first and second engaging members comprises a pair of spaced apart sections and an intermediate section interconnecting the spaced apart sections, each of the spaced apart sections being formed at its free end portion with an inwardly bent piece, the interconnecting member comprises a vertical piece-like body, the first engaging member and the second engaging member are vertically spaced apart from and generally parallel to each other and interconnected at the intermediate sections thereof by the vertical piece-like body of the interconnecting member, and when the fastener is applied to the electronic component the first engaging member is engaged with the cores so as to substantially surround the cores to clamp them and the second engaging member is engaged with an upper portion of the mold so as to substantially surround the upper portion of the mold to clamp it. The intermediate section of the first engaging member may be inwardly bowed for elastic support of the cores in cooperation with the inwardly bent pieces of the first engaging member when the fastener is applied to the electronic component. The intermediate section of the second engaging member may be inwardly bowed for elastic support of the upper portion of the mold in cooperation with the inwardly bent pieces of the second engaging member when the fastener is applied to the electronic component. The first and second engaging members are substantially resemblant in shape to each other. The inwardly bent pieces of the second engaging member may be formed so as to extend in a direction access to each other whereby when the fastener is applied to the electronic component the inwardly bent pieces of the second engaging member can be engaged with the recess of the mold.

In a preferred embodiment of the present invention, the first engaging member comprises a pair of spaced apart sections and an intermediate section interconnecting the spaced apart sections, each of the spaced apart sections being formed, at its free end portion, with an inwardly bent piece, the interconnecting member comprises a piece-like body extending from an upper edge of the intermediate section of the first engaging member, the second engaging member comprises a piece-like body, the piece-like body of the second engaging member extending upwardly from a free end of the piece-like body of the interconnecting member, and when the fastener is applied to the electronic component the first engaging member is engaged with the cores so as to substantially surround the cores to clamp them and the second engaging member is engaged with an upper portion of the mold. The intermediate section of the first engaging member may be inwardly bowed for elastic support of the cores in cooperation with the inwardly bent pieces of the first engaging member when the fastener is applied to the electronic component. The piece-like body of the second engaging member may be engaged with the recess of the mold when the fastener is applied to the electronic component.

In a preferred embodiment of the present invention, the first engaging member comprises a pair of spaced apart sections and an intermediate section interconnecting the spaced apart sections, each of the spaced apart sections being formed, at its free end portion, with an inwardly bent piece, the interconnecting member comprises a piece-like body extending upwardly from an upper edge of the intermediate section of the first engaging member, the second engaging member takes the form of a substantially cover-shield-like body, the substantially cover-shield-like body comprising a top plate section, a vertical plate section depending downwardly from a first portion of a periphery of the top plate section and connected to an upper portion of the piece-like body of the interconnecting member, and downwardly bent pieces formed at a second portion of the periphery of the top plate section which is opposite to the first portion of the periphery of the top plate section at which the vertical plate section is located, and when the fastener is applied to the electronic component the first engaging member is engaged with the cores so as to substantially surround the cores to clamp them and the second engaging member is engaged with an upper portion of the mold so as to cover the upper portion of the mold. The intermediate section of the first engaging member may be inwardly bowed for elastic support of the cores in cooperation with the inwardly bent pieces of the first engaging member when the fastener is applied to the electronic component. The vertical plate section of the second engaging member may be inwardly bowed for elastic support of the upper portion of the mold in cooperation with the downwardly bent pieces of the second engaging member when the fastener is applied to the electronic component.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, in which like reference numerals designate the same parts throughout the Figures and wherein.

DETAILED DESCRIPTION OF THE PREFERRED EMBODIMENTS

A fastener for an electronic component according to the present invention is adapted to be applied to an inductance element such as a surface-mounted-type pulse transformer or the like which is used in a hybrid integrated circuit for, e.g., a digital transmission, when the inductance element is assembled.

Before describing the unique design of the fastener of this invention, an inductance element to which the fastener of this invention is to be applied will be described in order to facilitate understanding of this invention. The inductance element comprises a coil structure.

Figure 1:
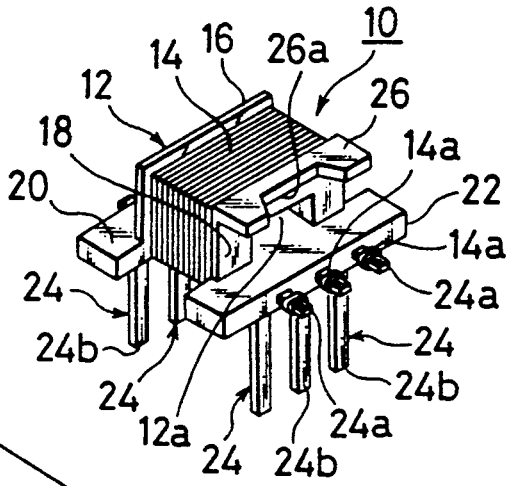
FIG. 1 is a schematic perspective view of an electronic component to which a fastener according to the present invention is to be applied, in which a mold and cores are omitted for clarity of illustration.

Referring to FIG. 1 illustrating an example of a coil structure of an inductance element, the coil structure 10 comprises a bobbin 12 having an axial portion, primary and second windings 14 around the axial portion of the bobbin 12, a pair of flanges 16 and 18 for regulating the coiling of the windings 14 around the axial portion of the bobbin 12 and integrally formed at opposing ends of the axial portion, and a pair of terminal blocks 20 and 22 integrally formed at lower end portions of the flanges 16 and 18 in a manner to project laterally from the flanges 16 and 18. A plurality of external terminals 24 are attached to each of the terminal blocks 20 and 22. Each of the external terminals 24 comprises a first projecting portion **24*a* projecting laterally from the terminal block, and a second projecting portion 24*b* projecting downwardly from the terminal block, around which first projecting portion 24*a* of the external terminal 24 a termination 14*a* of one of the windings 14 is coiled. In the example being illustrated, one of the flanges or the flange 18 is provided with a projecting piece 26 which projects laterally from an upper edge portion of the flange 18. The projecting piece 26 is formed with a notch 26*a*** which is used in order to constitute a recess portion (described in greater detail hereinafter) serving as means to specify a polarity and a direction of the inductance element when the inductance element is mounted on a printed circuit board.

Figure 2:
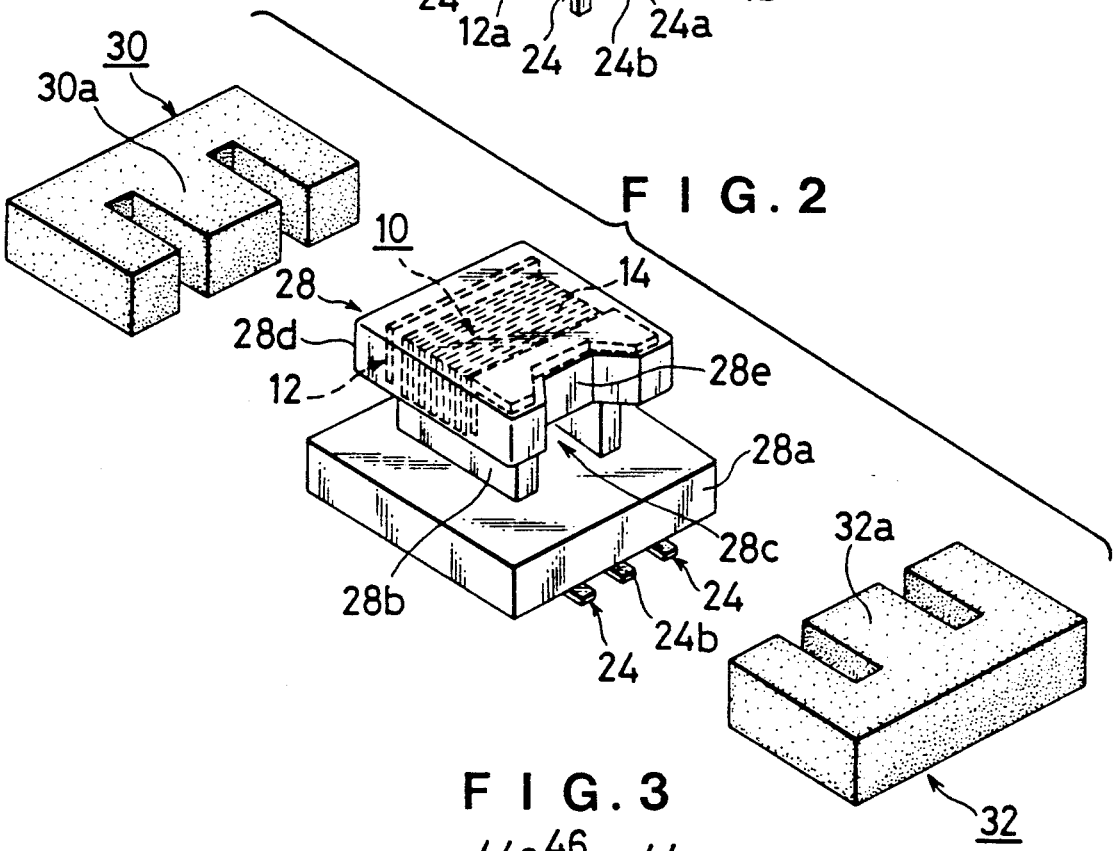
FIG. 2 is an exploded perspective view of the electronic component.

Referring to FIG. 2, the coil structure 10 constructed as described above is covered with a mold 28, which is formed of electrically insulating resin material, with the second projecting portions **24*b* of the external terminals 24 being projected outwardly from the mold 28. The mold 28 may be formed of electrically insulating resin material such as an epoxy resin, a phenolic resin or the like which has heat resistance. Preferably, the mold 28 is formed of resin material which has solvent resistance as well as heat resistance. The resin mold 28 comprises a horizontal plate-like base portion 28*a* covering the terminal blocks 20 and 22 and the first projecting portions 24*a* of the external terminals 24, a step portion 28*b* covering a substantially middle portion of the bobbin 12 and including a through-hole section 28*c* covering a surface of a bore 12*a* (see FIG. 1) of the bobbin 12, and a horizontal plate-like top portion 28*d* covering a substantially upper portion of the bobbin 12, which includes the projecting piece 26, and lying on the step portion 28*b* in parallel with the base portion 28*a*. The resin mold 28 covers the coil structure 10 in a manner to allow the appearance of the notch 26*a* of the projecting piece 26 to appear clearly, whereby a recess 28*e* briefly described above is provided at the top portion 28*d* of the mold 28. The recess 28***e* serves as means to specify a polarity and a direction of the inductance element when the inductance element is mounted on a printed circuit board. Even though the recess 28*e* is provided at a portion of the mold 28 covering the projecting piece 26, mechanical strength of the portion of the mold 28 will not fall because the projecting piece 26 is formed integrally with the flange 18 of the bobbin 12.

The inductance element further includes a pair of cores 30 and 32. In the example being illustrated, each of the cores is of a substantially E-shape. After the coil structure 10 is covered by the resin mold 28 in the manner described above, the substantially E-shaped cores 30 and 32 are assembled to the resin mold 28 so as to be opposed to each other. The assembling of the substantially E-shaped cores 30 and 32 to the resin mold 28 is performed by putting the cores 30 and 32 on the base portion 28*a* of the resin mold 28 and sliding the cores 30 and 32 on the base portion 28*a* in a direction access to each other to fit middle projecting sections 30*a* and 32*a* of the substantially E-shaped cores 30 and 32 into the through-holes section 28*c* of the resin mold 28 so as to cause the cores 30 and 32 to come into close contact with each other. The cores 30 and 32 assembled with respect to the resin mold 28 in the manner described above are interposed between the base portion 28*a* and top portion 28*d* of the resin mold 28.

While the E-shaped cores in a pair are employed in the example being illustrated, a substantially E-shaped core and a substantially I-shaped core in a pair may be also employed. When a substantially E-shaped core and a substantially I-shaped core in a pair are employed, the substantially E-shaped core is seated with respect to the step portion 28*b* of the resin mold 28 so as to be inserted, at its middle projecting section, in the through-hole section 28*c* of the resin mold 28, and the substantially I-shaped core is seated with respect to the step portion 28*b* of the resin mold 28 so as to come into close contact with the substantially E-shaped core.

The fastener of the present invention is used in order to firmly clamp and position the cores, assembled to the resin mold 28 covering the coil structure 10 as described above, on the mold 28. The fastener comprises a first engaging member being engaged with the cores, when the fastener is applied to the inductance element, to clamp the cores, a second engaging member being engaged with a portion of the mold when the fastener is applied to the inductance element, and an interconnecting member interconnecting the first and second engaging members. The first and second engaging members and the interconnecting member are integrally formed of elastic material and may be integrally formed of a thin metal plate such as a thin stainless steel plate, which has built-in elasticity. Alternatively, they are integrally formed of a relatively hard synthetic resin material which has heat resistance and solvent resistance as well as elasticity.

Figure 3:
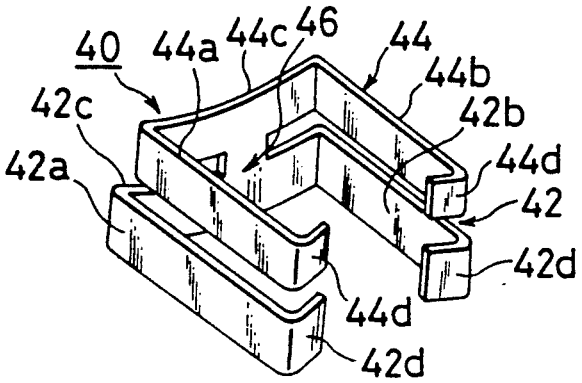
FIG. 3 is a schematic perspective view of a fastener according to a first embodiment of the present invention.
Figure 4:
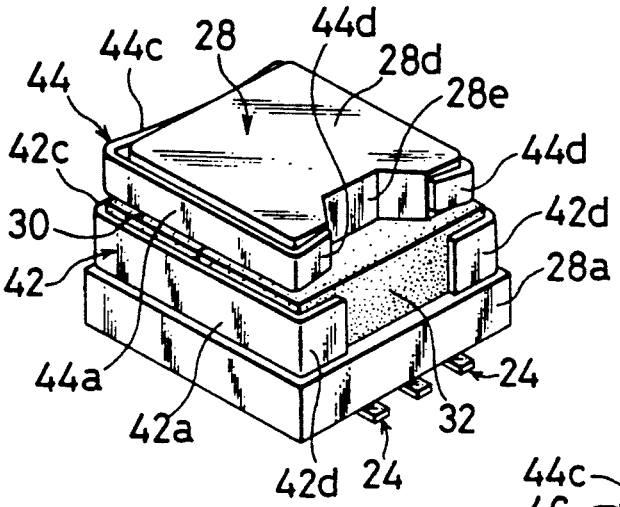
FIG. 4 is a schematic perspective view of the electronic component in which cores are fastened to a resin mold by means of the fastener shown in FIG. 3.
Figure 5:
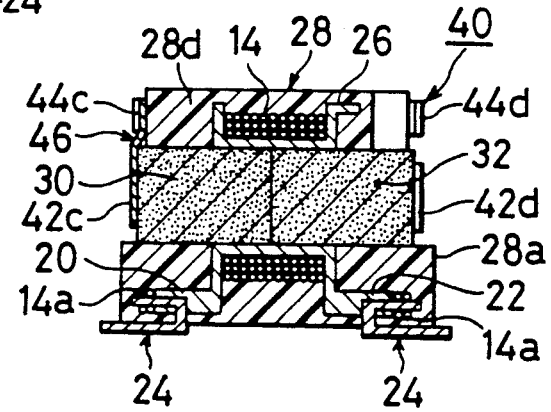
FIG. 5 is a schematic sectional view of the electronic component shown in FIG. 4.

Referring now to FIGS. 3 to 5 illustrating a fastener according to a first embodiment of this invention, the fastener 40 comprises a first engaging member 42 being engaged with the cores 30 and 32, when the fastener 40 is applied to the inductance element, to clamp the cores 30 and 32, a second engaging member 44 being engaged with the top portion 28*d* of the resin mold 28 when the fastener is applied to the inductance element, and an interconnecting member 46 interconnecting the first and second engaging members 42 and 44. In the illustrated embodiment, the first engaging member 42 comprises a strip-like body of a substantially U-shape which includes a pair of spaced apart sections 42*a* and 42*b* and an intermediate section 42*c* interconnecting the spaced apart sections 42*a* and 42*b*. Each of the spaced apart sections 42*a* and 42*b* is formed at its free end portion with an inwardly bent piece 42*d*. Like the first engaging member 42, the second engaging member 44 comprises a strip-like body of a substantially U-shape which includes a pair of spaced apart sections 44*a* and 44*b* and an intermediate section 44*c* interconnecting the spaced apart sections 44*a* and 44*b*. Also, each of the spaced apart sections 44*a* and 44*b* of the second engaging member 44 is formed at its free end portion with an inwardly bent piece 44*d*. Thus, the first engaging member 42 and second engaging member 44 are substantially resemblant in shape to each other. The first engaging member 42 and the second engaging member 44 are vertically spaced apart from and substantially parallel to each other and interconnected at their intermediate sections 42*c* and 44*c* by the interconnecting member 46 comprising a vertical piece-like body.

As shown in FIG. 4, the fastener 40 constructed as described above is adapted to be applied to the inductance element in a manner such that the first engaging member 42 disposes the cores 30 and 32 within a spacing defined by the sections 42*a*, 42*b* and 42*c* of the first engaging member 42 and the inwardly bent pieces 42*d* of the first engaging member 42 are engaged with a side of the cores 32, and in a manner such that the second engaging member 44 disposes the top portion 28*d* of the resin mold 28 within a spacing defined by the sections 44*a*, 44*b* and 44*c* of the second engaging member 44 and the inwardly bent pieces 44*d* of the second engaging member 44 are engaged with a side of the top portion 28*d* in which the recess portion 28*e* is formed.

In the inductance element to which the fastener 40 is applied in the manner described above, the first engaging member 42 is in close engagement with the cores 30 and 32 so as to substantially surround the cores 30 and 32 to clamp them and the second engaging member 44 is in close engagement with the top portion 28*d* of the resin mold 28 so as to substantially surround the top portion 28*d*. The first engaging member 42 and the second engaging member 44 are interconnected by the interconnecting member 46 as described above, so that even though any spacing exists between the cores 30 and 32 and the resin mold 28 when the fastener 40 is applied to the inductance element, the cores can be positively positioned with respect to the resin mold 28 by means of the fastener 40 with no possibility of jolting in vertical and lateral directions. Preferably, the intermediate section 42*c* of the first engaging member 42 may be inwardly bowed for elastic support of the cores 30 and 32 in cooperation with the inwardly bent pieces 42*d* of the first engaging member 42. Like the intermediate section 42*c* of the first engaging member 42, the intermediate section 44*c* of the second engaging member 44 may be inwardly bowed for elastic support of the top portion 28*d* of the resin mold 28 in cooperation with the inwardly bent pieces 44*d* of the second engaging member 44. When the fastener 40 is applied to the inductance element in the manner described above, the inwardly bowed intermediate section 42*c* of the first engaging member 42 and the inwardly bowed intermediate section 44*c* of the second engaging member 44 are deformed outwardly by engagement of the inwardly bent pieces 42*d* of the first engaging member 42 with the core 32 and engagement of the inwardly bent pieces 44*d* of the second engaging member 44 with the top portion 28*d* of the resin mold 28. Thus, the first engaging member 42 and the second engaging member 44 can firmly clamp the cores 30 and 32, and the top portion 28*d* of the resin mold 28, respectively. The applying of the fastener 40 to the inductance element may be carried out by causing the spaced apart sections 42*a* and 42*b* of the first engaging member 42 to be opened away from each other and also causing the spaced apart sections 44*a* and 44*b* of the second engaging member 44 to be opened away from each other and then putting the fastener on the inductance element in a manner such that the first engaging member 42 and the second engaging member 44 are engaged with the cores 30 and 32, and the top portion 28*d* of the resin mold 28, respectively. In this case, when the fastener is put on the inductance element and released, the spaced apart sections 42*a* and 42*b* of the first engaging member 42 and the spaced apart sections 44*a* and 44*b* of the second engaging member 44 are restored to their original states due to elasticity to elastically clamp the cores 30 and 32 and the top portion 28*d* of the resin mold 28, respectively. Thus, the fitting of the fastener 40 on the inductance element can be easily performed.

Incidentally, the inwardly bent pieces 44*d* of the second engaging member 44 may be formed so as to extend in a direction access to each other. In this case, the fastener may be applied to the inductance element in a manner such that end portions of the so-extending bent pieces 44*d* are engaged with the recess portion 28*e* of the resin mold 28.

The fastener of this invention may be fitted on the inductance element in a position or posture different from that of the fastener shown in FIGS. 4 and 5. That is, the fastener may be fitted on the inductance element in a manner such that the intermediate sections 42*c* and 44*c* of the first and second engaging members 42 and 44 and the interconnecting member 46 are situated on the side of the resin mold 28 at which the recess portion 28*e* is located.

Figure 6:
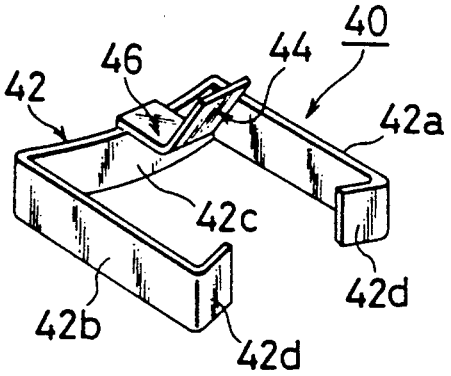
FIG. 6 is a schematic perspective view of a fastener according to a second embodiment of the present invention.

FIG. 6 shows a fastener according to a second embodiment of this invention. The fastener of this embodiment is generally similar to that of FIGS. 3 to 5 except that the construction of a second engaging member and an interconnecting member is different from that of the second engaging member and interconnecting member of the fastener shown in FIGS. 3 to 5. In the second embodiment, parts which are similar to those shown in FIGS. 3 to 5 are designated with like reference numerals and the description of them will not be repeated.

Referring now to FIG. 6, an interconnecting member 46 comprises a horizontal piece-like body extending inwardly of the substantially U-shaped body of the first engaging member 42 from the intermediate section 42*c* of the first engaging member 42, and a second engaging member 44 comprises a substantially piece-like body which extends obliquely and upwardly from a free end of the horizontal piece-like body of the interconnecting member 46. Unlike the fastener shown in FIGS. 4 and 5, the fastener 40 of FIG. 6 is adapted to be fitted on the inductance element in a manner such that the intermediate section 42*c* of the first engaging member 42, the second engaging member 44 and the interconnecting member 46 are situated on the side of the resin mold 28 at which the recess portion 28*e* is located as shown in FIG. 4. When the fastener is fitted on the inductance element, the piece-like body of the second engaging member 44 is adapted to be engaged with the recess portion 28*e* of the resin mold 28 in a manner to be elastically fitted in the recess portion 28*e* due to its built-in elasticity. In the fastener of the second embodiment fitted on the inductance element in the manner described above, the piece-like body of the second engaging member 44 is in close engagement with the recess portion 28*e* of the resin mold 28 as described above, so that even though any external force is accidentally applied to the inductance element, there is no risk of the cores, clamped by the first engaging member 42, being jolted laterally. Further, the piece-like body of the second engaging member 44 is elastically fitted in the recess portion 28*e* of the resin mold 28, whereby the cores on the base portion 28*a* of the resin mold 28 can be positively positioned in a manner not to be jolted vertically even though any external force is accidentally applied to the inductance element. In addition to this, in the second embodiment, the second engaging member 44 is in the form of the piece-like body extending from the body of the interconnecting member 46, so that when compared to the fastener of FIGS. 3 to 5, the fastener according to the second embodiment can be easily produced with the use of less material and is simple.

Figure 7:
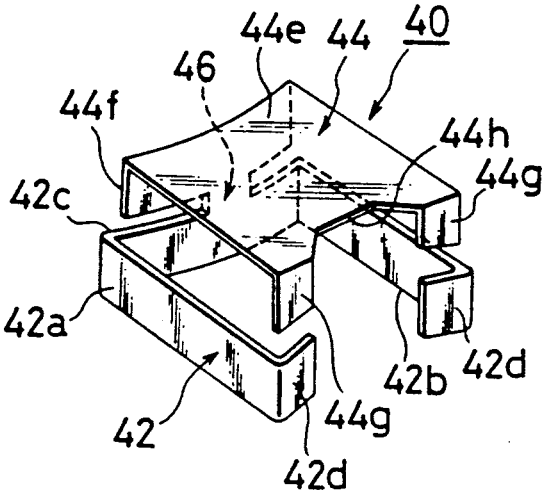
FIG. 7 is a schematic perspective view of a fastener according to a third embodiment of the present invention.

FIG. 7 shows a fastener according to a third embodiment of this invention. This fastener is adapted to be fitted on the inductance element in the same posture as the fastener of FIGS. 4 and 5 is done, and generally similar to that of FIGS. 3 to 5 except that the construction of a second engaging member is different from that of the second engaging member of the fastener shown in FIGS. 3 and 5. In the third embodiment, parts which are similar to those shown in FIGS. 3 to 5 are designated with like reference numerals and the description of them will not be repeated.

Referring now to FIG. 7, a second engaging member 44 takes the form of a substantially cover-shield-like body. The substantially cover-shield-like body of the second engaging member 44 includes a top plate section 44*e*, a vertical plate section 44*f* depending downwardly from a first portion of a periphery of the top plate section 44*e* and connected to the interconnecting member 46, and a pair of downwardly bent pieces 44*g* spaced apart from each other and provided at a second portion of the periphery of the top plate section 44*e* which is opposite to the first portion of the periphery of the top plate section 44*e* at which the vertical plate section 44*f* is located. When the fastener is to be applied to an inductance element having a recess portion 28*e* (see FIG. 2), the top plate section 44*e* of the second engaging member 44 may be formed at its portion which positionally corresponds, when the fastener is fitted on the inductance element, to a portion of a resin mold of the inductance element at which the recess portion 28*e* is located, with a notch 44*h* generally corresponding in shape to the recess portion 28*e* of the resin mold 28. The fastener 40 of the third embodiment is adapted to be fitted on the inductance element in a manner such that the substantially cover-shield-like body of the second engaging member 44 covers the top portion 28*d* of the mold 28. In the fastener of the third embodiment fitted on the inductance element in the manner described above, the second engaging member 44 tightly clamp the top portion 28*d* of the mold 28 and the first engaging member 42 positively positions the cores 30 and 32 on the base portion 28*a* of the mold 28 in a manner not to allow the cores to be jolted laterally and vertically even though any external force is accidentally applied to the inductance element. Further, the second engaging member 44 can cover the top portion 28*d* of the mold 28, thereby producing the effect of shielding magnetism in the inductance element. Preferably, the vertical plate section 44*f* of the second engaging member 44 may be inwardly bowed for elastic support of the top portion 28*d* of the mold 28 in cooperation with the downwardly bent pieces 44*g*.

As described above, in the fastener according to the present invention, the first engaging member being engaged with cores of an inductance element to clamp them and the second engaging member being engaged with a portion of a mold of the inductance element are integrally interconnected by the interconnecting member, so that when the fastener is applied to the inductance element, the cores can be effectively clamped and positively positioned with respect to the resin mold with no possibility of being jolted laterally and vertically even though any vibration, shock and/or impact are accidentally applied to the inductance element. Therefore, according to this invention, it is possible to provide a fastener which is useful in increasing the resistance of an inductance element to vibration, impact and shock. In addition, the fastener according to the present invention can be easily applied to an inductance element without degrading characteristics of cores. Furthermore, according to this invention, it is possible to provide a fastener which can be manufactured at low cost and also provide a fastener which is useful in enhancing the effect of shielding magnetism in an inductance element.

It will thus be seen that the objects set forth above, and those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In a combination of a fastener with an electronic component, wherein said fastener is fitted on said electronic component, said electronic component comprising a bobbin having an axial portion, windings around the axial portion of said bobbin, external terminals projecting from said bobbin, around each of which external terminals a termination of one of said windings is coiled, a mold covering said bobbin so as to allow portions of said external terminals to be projected outwardly from said mold, said mold being formed of electrically insulating resin material, and a pair of cores mounted to said mold so as to be opposed to each other, and said fastener comprising:

a first engaging member engaged with said cores to clamp said cores of said electronic component, a second engaging member engaged with a portion of said mold, and an interconnecting member interconnecting said first and second engaging members.

2. The combination as defined in claim 1, wherein said first and second engaging members and said interconnecting member are integrally formed of elastic material.

3. The combination as defined in claim 1, wherein said first and second engaging members and said interconnecting member are integrally formed of a thin metal plate.

4. The combination as defined in claim 3, wherein said metal plate is a thin stainless steel plate.

5. The combination as defined in claim 1, wherein said first and second engaging members and said interconnecting member are integrally formed of a relatively hard synthetic resin material which has elasticity, heat resistance and solvent resistance.

6. The combination as defined in claim 1, wherein said mold includes a base portion covering a substantially lower portion of said bobbin, a step portion covering a substantially middle portion of said bobbin and including a through-hole section covering a surface of a bore of said bobbin, and a top portion covering a substantially upper portion of said bobbin, and each of said cores is a substantially E-shaped body, said cores being seated with respect to said step portion of said mold so as to be inserted, at middle projecting sections thereof, in said through-hole section of said mold.

7. The combination as defined in claim 1, wherein said mold includes a base portion covering a substantially lower portion of said bobbin, a step portion covering a substantially middle portion of said bobbin and having a through-hole section covering a surface of a bore of said bobbin, and a top portion covering a substantially upper portion of said bobbin, and one of said cores is a substantially E-shaped body and is seated with respect to said step portion of said mold so as to be inserted, at a middle projecting section thereof, in said through-hole section of said mold, and the other of said cores is a substantially I-shaped body and is seated with respect to said step portion of said mold.

8. The combination as defined in claim 6, wherein said top portion of said mold is provided with means serving to specify a polarity and a direction of said electronic component.

9. The combination as defined in claim 8, wherein said means of said mold includes a recess.

10. The combination as defined in claim 7, wherein said top portion of said mold is provided with means serving to specify a polarity and a direction of said electronic component.

11. The combination as defined in claim 10 wherein said means of said mold includes a recess.

12. The combination as defined in claim 1, wherein each of said first and second engaging members includes a pair of spaced apart sections and an intermediate section interconnecting said spaced apart sections, each of said spaced apart sections being formed at a free end portion thereof with an inwardly bent piece; wherein said interconnecting member comprises a vertical piece-like body; wherein said first engaging member and said second engaging member are vertically spaced apart from and generally parallel to each other and interconnected at said intermediate sections thereof by said vertical piece-like body of said interconnecting member; and wherein in assembly said first engaging member is engaged with said cores so as to substantially surround said cores and said second engaging member is engaged with an upper portion of said mold so as to substantially surround the upper portion of said mold to clamp the upper portion.

13. The combination as defined in claim 12, wherein said intermediate section of said first engaging member is inwardly bowed for elastic support of said cores in cooperation with said inwardly bent pieces of said first engaging member; and wherein said intermediate section of said second engaging member is inwardly bowed for elastic support of the upper portion of said mold in cooperation with said inwardly bent pieces of said second engaging member.

14. The combination as defined in claim 12, wherein said first and second engaging members are substantially similar in shape to each other.

15. The combination as defined in claim 9, wherein each of said first and second engaging members includes a pair of spaced apart sections and an intermediate section interconnecting said spaced apart sections, each of said spaced apart sections being formed at a free end portion thereof with an inwardly bent piece; wherein said interconnecting member includes a vertical piece-like body; wherein said first engaging member and said second engaging member are vertically spaced apart from and generally parallel to each other and interconnected at said intermediate sections thereof by said vertical piece-like body of said interconnecting member; wherein in assembly said first engaging member is engaged with said cores so as to substantially surround said cores and said second engaging member is engaged with an upper portion of said mold so as to substantially surround the upper portion of said mold to clamp the upper portion; and wherein said inwardly bent pieces of said second engaging member are extended in a direction access to each other so that in assembly they are engaged with said recess of said mold.

16. The combination as defined in claim 15, wherein said intermediate section of said first engaging member is inwardly bowed for elastic support of said cores in cooperation with said inwardly bent pieces of said first engaging member; and wherein said intermediate section of said second engaging member is inwardly bowed for elastic support of the top portion of said mold in cooperation with said inwardly bent pieces of said second engaging member.

17. The combination as defined in claim 11, wherein each of said first and second engaging members includes a pair of spaced apart sections and an intermediate section interconnecting said spaced apart sections, each of said spaced apart sections being formed at a free end portion thereof with an inwardly bent piece; wherein said interconnecting member includes a vertical piece-like body; wherein said first engaging member and said second engaging member are vertically spaced apart from and generally parallel to each other and interconnected at said intermediate sections thereof by said vertical piece-like body of said interconnecting member; wherein in assembly said first engaging member is engaged with said cores so as to substantially surround said cores and said second engaging member is engaged with the top portion of said mold so as to substantially surround the top portion of said mold to clamp the top portion; and wherein said inwardly bent pieces of said second engaging member are extended in a direction access to each other so that in assembly they are engaged with said recess of said mold.

18. The combination as defined in claim 17, wherein said intermediate section of said first engaging member is inwardly bowed for elastic support of said cores in cooperation with said inwardly bent pieces of said first engaging member; and wherein said intermediate section of said second engaging member is inwardly bowed for elastic support of the top portion of said mold in cooperation with said inwardly bent pieces of said second engaging member.

19. The combination as defined in claim 1, wherein said first engaging member includes a pair of spaced apart sections and an intermediate section interconnecting said spaced apart sections, each of said spaced apart sections being formed at a free end portion thereof with an inwardly bent piece; wherein said interconnecting member includes a piece-like body extending from an upper edge of said intermediate section of said first engaging member; wherein said second engaging member includes a piece-like body, said piece-like body of said second engaging member extending upwardly from a free end of said piece-like body of said interconnecting member; and wherein in assembly said first engaging member is engaged with said cores so as to substantially surround said cores and said second engaging member is engaged with an upper portion of said mold.

20. The combination as defined in claim 19, wherein said intermediate section of said first engaging member is inwardly bowed for elastic support of said cores in cooperation with said inwardly bent pieces of said first engaging member.

21. The combination as defined in claim 9, wherein said first engaging member includes a pair of spaced apart sections and an intermediate section interconnecting said spaced apart sections, each of said spaced apart sections being formed at a free end portion thereof with an inwardly bent piece; wherein said interconnecting member includes a piece-like body extending from an upper edge of said intermediate section of said first engaging member; wherein said second engaging member includes a piece-like body extending upwardly from a free end of said piece-like body of said interconnecting member; and wherein in assembly said first engaging member is engaged with said cores so as to substantially surround said cores and said piece-like body of said second engaging member is engaged with said recess of said mold.

22. The combination as defined in claim 21, wherein said intermediate section of said first engaging member is inwardly bowed for elastic support of said cores in cooperation with said inwardly bent pieces of said first engaging member.

23. The combination as defined in claim 11, wherein said first engaging member includes a pair of spaced apart sections and an intermediate section interconnecting said spaced apart sections, each of said spaced apart sections being formed at a free end portion thereof with an inwardly bent piece; wherein said interconnecting member includes a piece-like body extending from an upper edge of said intermediate section of said first engaging member; wherein said second engaging member includes a piece-like body extending upwardly from a free end of said piece-like body of said interconnecting member; and wherein in assembly said first engaging member is engaged with said cores so as to substantially surround said cores and said piece-like body of said second engaging member is engaged with said recess of said mold.

24. The combination as defined in claim 23, wherein said intermediate section of said first engaging member is inwardly bowed for elastic support of said cores in cooperation with said inwardly bent pieces of said first engaging member.

25. The combination as defined in claim 1, wherein said first engaging member includes a pair of spaced apart sections and an intermediate section interconnecting said spaced apart sections, each of said spaced apart sections being formed at a free end portion thereof with an inwardly bent piece; wherein said interconnecting member includes a piece-like body extending upwardly from an upper edge of said intermediate section of said first engaging member; wherein said second engaging member is a substantially cover-shield-like body, said substantially cover-shield-like body including a top plate section, a vertical plate section depending downwardly from a first portion of a periphery of said top plate section and connected to an upper portion of said piece-like body of said interconnecting member, and downwardly bent pieces formed at a second portion of the periphery of said top plate section which is opposite to the first portion of the periphery of said top plate section at which said vertical plate section is located; and wherein in assembly said first engaging member is engaged with said cores so as to substantially surround said cores and said second engaging member is engaged with an upper portion of said mold so as to cover the upper portion of said mold.

26. The combination as defined in claim 25, wherein said intermediate section of said first engaging member is inwardly bowed for elastic support of said cores in cooperation with said inwardly bent pieces of said first engaging member; and wherein said vertical plate section of said second engaging member is inwardly bowed for elastic support of the upper portion of said mold in cooperation with said downwardly bent pieces of said second engaging member.

27. The combination as defined in claim 9, wherein said first engaging member includes a pair of spaced apart sections and an intermediate section interconnecting said spaced apart sections, each of said spaced apart sections being formed at a free end portion thereof with an inwardly bent piece; wherein said interconnecting member includes a piece-like body extending upwardly from an upper edge of said intermediate section of said first engaging member; wherein said second engaging member is a substantially cover-shield-like body, said substantially cover-shield-like body comprising a top plate section, a vertical plate section depending downwardly from a first portion of a periphery of said top plate section and connected to an upper portion of said piece-like body of said interconnecting member, and downwardly bent pieces formed at a second portion of the periphery of said top plate section which is opposite to the first portion of the periphery of said top plate section at which said vertical plate section is located; wherein in assembly said first engaging member is engaged with said cores so as to substantially surround said cores and said second engaging member is engaged with the top portion of said mold so as to cover the top portion of said mold; and wherein said top plate section of said second engaging member is formed with a notch, generally corresponding in shape to said recess of said mold, at a portion thereof which positionally corresponds to said recess of said mold.

28. The combination as defined in claim 27, wherein said intermediate section of said first engaging member is inwardly bowed for elastic support of said cores in cooperation with said inwardly bent pieces of said first engaging member; and wherein said vertical plate section of said second engaging member is inwardly bowed for elastic support of the top portion of said mold in cooperation with said downwardly bent pieces of said second engaging member.

29. The combination as defined in claim 11, wherein said first engaging member includes a pair of spaced apart sections and an intermediate section interconnecting said spaced apart sections, each of said spaced apart sections being formed at a free end portion thereof with an inwardly bent piece; wherein said interconnecting member includes a piece-like body extending upwardly from an upper edge of said intermediate section of said first engaging member; wherein said second engaging member is a substantially cover-shield-like body, said substantially cover-shield-like body including a top plate section, a vertical plate section depending downwardly from a first portion of a periphery of said top plate section and connected to an upper portion of said piece-like body of said interconnecting member, and downwardly bent pieces formed at a second portion of the periphery of said top plate section which is opposite to the first portion of the periphery of said top plate section at which said vertical plate section is located; wherein in assembly said first engaging member is engaged with said cores so as to substantially surround said cores and said second engaging member is engaged with the top portion of said mold so as to cover the top portion of said mold; and wherein said top plate section of said second engaging member is formed with a notch, generally corresponding in shape to said recess of said mold, at a portion thereof which positionally corresponds to said recess of said mold.

30. The combination as defined in claim 29, wherein said intermediate section of said first engaging member is inwardly bowed for elastic support of said cores in cooperation with said inwardly bent pieces of said first engaging member; and wherein said vertical plate section of said second engaging member is inwardly bowed for elastic support of the top portion of said mold in cooperation with said downwardly bent pieces of said second engaging member.

* * * * *